US007106004B1

(12) United States Patent
Greenwood

(10) Patent No.: US 7,106,004 B1
(45) Date of Patent: Sep. 12, 2006

(54) ALL CAVITY MAGNETRON AXIAL EXTRACTOR

(75) Inventor: Andrew D. Greenwood, Albuquerque, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 129 days.

(21) Appl. No.: 11/015,316

(22) Filed: Dec. 20, 2004

(51) Int. Cl.
*H01J 25/50* (2006.01)

(52) U.S. Cl. ..... 315/39.51; 315/5.41; 313/153

(58) Field of Classification Search ..... 315/5.41, 315/5.46, 5.51, 39.51, 39.59, 39.63; 313/153, 313/155; 331/5, 89
See application file for complete search history.

(56) References Cited

U.S. PATENT DOCUMENTS 5,361,016 A * 11/1994 Ohkawa et al. ..... 315/111.41
6,060,833 A * 5/2000 Velazco ..... 315/5.41

* cited by examiner

*Primary Examiner*—Tuyet Vo
*Assistant Examiner*—Jimmy Vu
(74) *Attorney, Agent, or Firm*—James M. Skorich

(57) ABSTRACT

An axial extractor to efficiently extract microwave power from any magnetron. The axial extractor is both more compact and offers improved overall performance compared to the prior art. The axial extractor allows for suppression of the parasitic magnetron 0 mode, lowers field stress inside the device, and lowers the frequency of operation. These improvements also make it possible for the magnetron itself to be made smaller without a loss of power output.

4 Claims, 5 Drawing Sheets

ALL CAVITY MAGNETRON AXIAL EXTRACTOR

STATEMENT OF GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

BACKGROUND

Arising from an effort to design a compact magnetron that would produce approximately 1 GW output power at or near a frequency of 1.3 GHz, it was determined that the traditional radial extractor design would not fit into the desired size constraints, as shown in FIG. 1. Thus there developed a need to design a new way for extracting microwave power from a magnetron while maintaining a compact, efficient package.

The new axial extractor design was derived from considering the magnetic coupling employed by a rectangular slotted waveguide antenna and applying reciprocity. A piece of a typical slotted waveguide antenna, designed to radiate the lowest order ($TE_{10}$) mode, is shown in FIG. 2. Note that, in order to radiate, the slots must be placed such that the current on the waveguide wall is interrupted. For a $TE_{10}$ mode propagating in a hollow waveguide, the time harmonic electromagnetic fields in phasor form ($e^{-i\omega t}$ time convention) are given by $$E = \hat{y}E_0 \sin\left(\frac{\pi}{a}x\right)e^{ik_z z}$$

$$H = \frac{E_0}{\eta_0}\left[-\hat{x}\frac{k_z}{k}\sin\left(\frac{\pi}{a}x\right) - \hat{z}i\frac{\pi}{ka}\cos\left(\frac{\pi}{a}x\right)\right]e^{ik_z z}$$

where $E_0$ is the wave amplitude, $\eta_0$ is the impedance of the free space, $k=w/c=2\pi/\lambda_0$ is the free space electromagnetic wavenumber, $\omega$ is the radian frequency, c is the speed of light, $k_z=\sqrt{k^2-(\pi/a)^2}=2\pi/\lambda_g$ is the waveguide propagation constant, $\lambda_0$ is the free space electromagnetic wavelength, $\lambda_g$ is the wavelength inside the waveguide, and $i=\sqrt{-1}$. The surface current density in the top waveguide wall is then given by $$J_s = -\hat{y}\times H = \frac{E_0}{\eta_0}\left[\hat{x}i\frac{\pi}{ka}\cos\left(\frac{\pi}{a}x\right) - \hat{z}\frac{k_z}{k}\sin\left(\frac{\pi}{a}x\right)\right]e^{ik_z z}$$

Thus, the transverse ($\hat{x}$-directed) current on the top wall has a cosine distribution with a null along the center axis of the wall. A slot cut along the center axis of the wall does not radiate, which is the reason the slots in FIG. 2 are located off the center axis. Further, the radiation from two side-by-side slots symmetric about the center axis of the wall is 180° out of phase and tends to cancel. Thus, the slots on the opposite sides of the center axis of the wall are spaced one half of a waveguide wavelength ($\lambda_g/2$) so the radiation is in phase. By reciprocity, to excite a $TE_{10}$ mode in a rectangular waveguide through a slot in a broad wall, the slot must be located off the center axis of the wall. Two side-by-side slots on opposite sides of the center axis excite the $TE_{10}$ mode if they are driven 180° out of phase.

Based on the slotted waveguide antenna and reciprocity, coupling slots to a rectangular waveguide are cut in the end walls of alternating cavities of the magnetron. Each waveguide axis is aligned with the magnetron axis, as shown in FIGS. 3*a* and 3*b*. The development of this magnetic coupling scheme with rectangular, axially-orientated extraction waveguides did not resolve the compactness requirements, but was a vital stepping stone to the development of the all cavity magnetron axial extractor.

SUMMARY

The present invention is directed to the use of axial extractors, covering all cavities of a magnetron, to efficiently extract microwave power from that magnetron. The present invention allows for superior power extraction, improved device performance, and reduction in the overall size of the device.

The preferred embodiment constitutes a six-cavity magnetron using three, 90° sectoral, axial extractors covering all six of the magnetron cavities. While this constitutes the preferred embodiment, the axial extraction scheme can be equally well utilized on any magnetron with an even number of cavities. If N were considered the even number of cavities in a particular magnetron, then N/2 constitutes the number of axial extractors needed.

While many other magnetron power extraction schemes are possible, none offer the advantages of compact design and improved overall performance offered by the axial extraction scheme proposed herein.

Additionally, other aspects and advantages of the present invention will become apparent from the following detailed description, taken in conjunction with the accompanying drawings, illustrating by way of example, the principle of the invention.

DETAILED DESCRIPTION

It has been noted that two side-by-side slots in the broad wall of a rectangular waveguide excite the lowest order ($TE_{10}$) mode if they are driven 180° out of phase. Magnetrons are specifically designed to operate in the $\pi$ mode, which is characterized by a phase shift of $\pi$ radians (180°) between the fields in adjacent cavities. Thus, it is determined that two adjacent cavities can drive a low order mode in a single waveguide.

Figure 4:
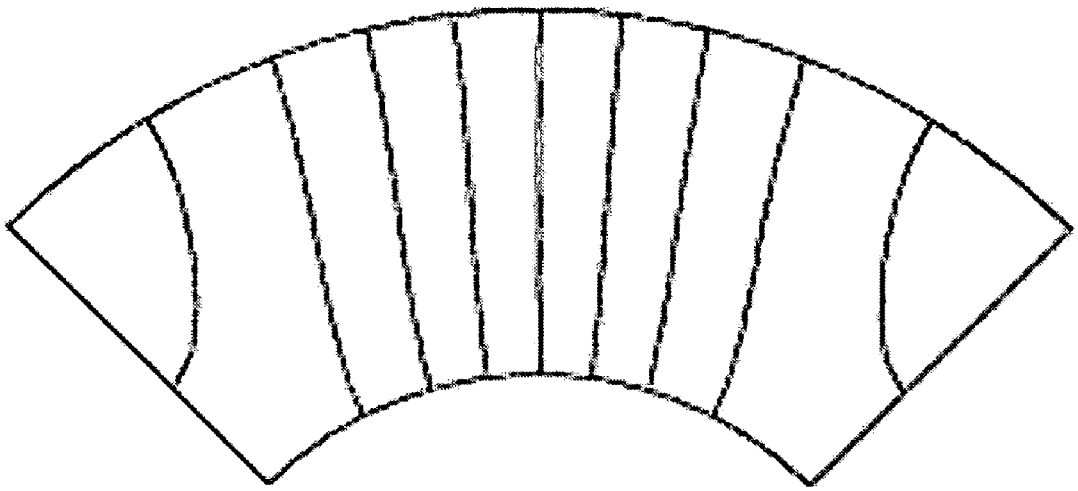
FIG. 4 illustrates the transverse electric field configuration of the lowest order mode in a 90° sectoral waveguide.

In order to connect the two adjacent magnetron cavities, the waveguides must be modified into sector shaped waveguides. The preferred embodiment constitutes a six-cavity magnetron, with waveguides of a 90° sector that have an inner radius of approximately 8.59 cm, an outer radius of approximately 16.85 cm, and a height of approximately 8.25 cm. In this example, the cutoff frequency for the lowest order mode in these modified waveguides was 750 MHz, and the cutoff frequency for the next mode was 1.46 GHz (making the desired 1.3 GHz magnetron frequency within the single frequency band of these waveguides). The transverse electric field configuration of the lowest order mode is illustrated in FIG. 4, where it is seen to be very similar to the $TE_{10}$ mode in the rectangular waveguide.

Figure 1:
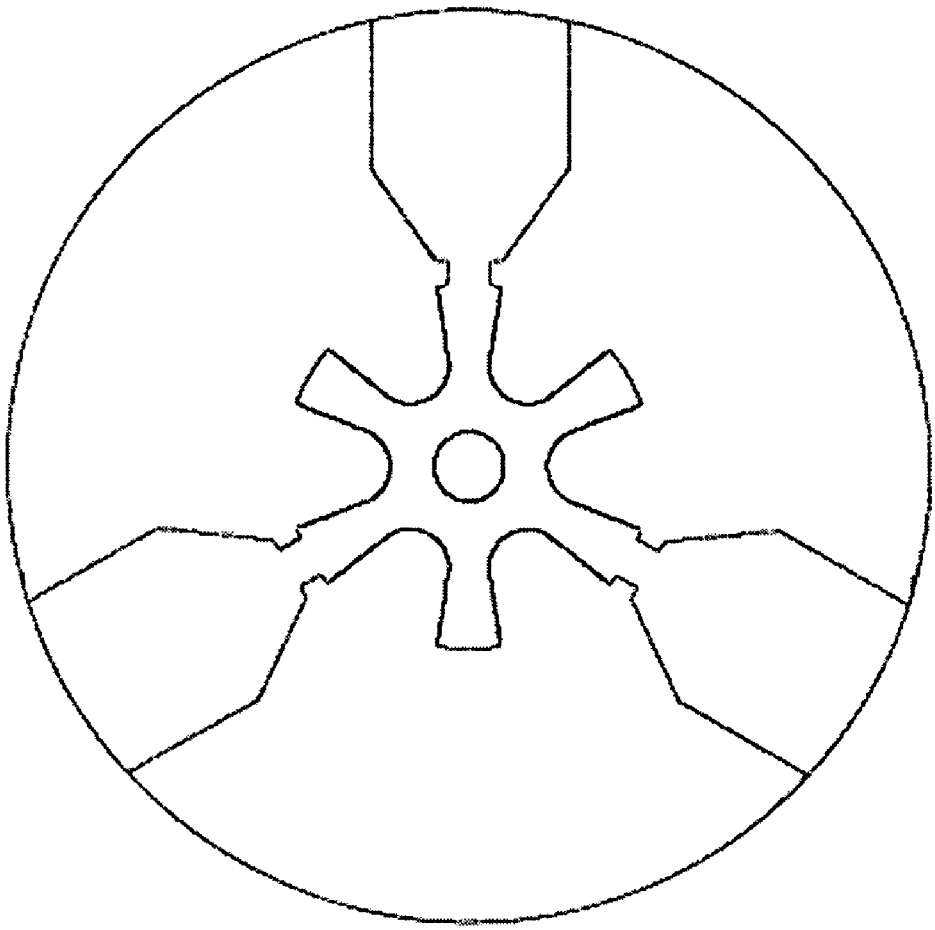
FIG. 1 illustrates the prior art magnetron with three radial extractors, viewed perpendicular to the axis, with reference circle.
Figure 2:
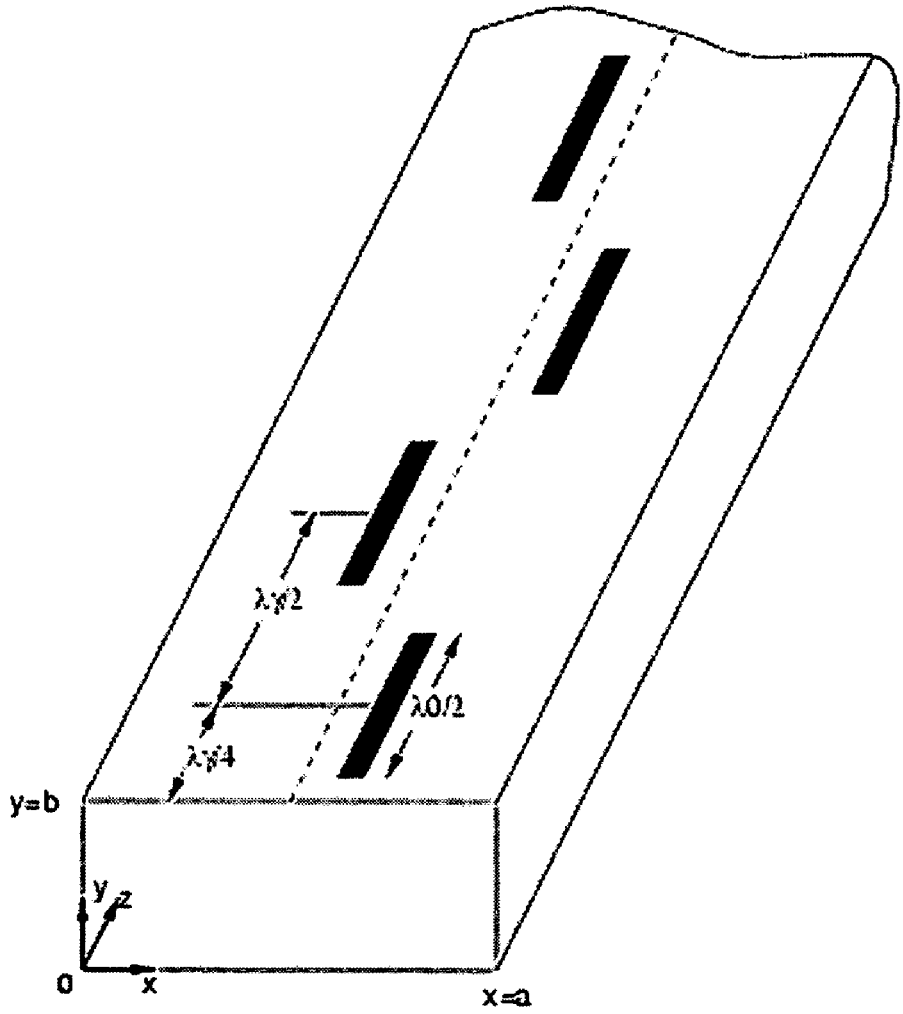
FIG. 2 illustrates a segment of typical slotted waveguide antenna designed to radiate the lowest order ($TE_{10}$) mode.
Figure 3A:
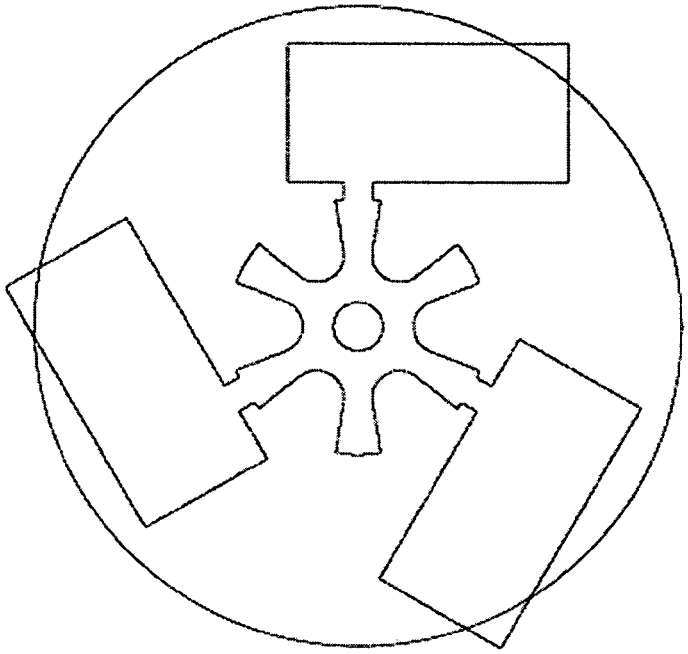
FIG. 3*a* illustrates a magnetron with three axially-orientated waveguide extractors, viewed perpendicular to the axis, with reference circle of same size as FIG. 1.
Figure 3B:
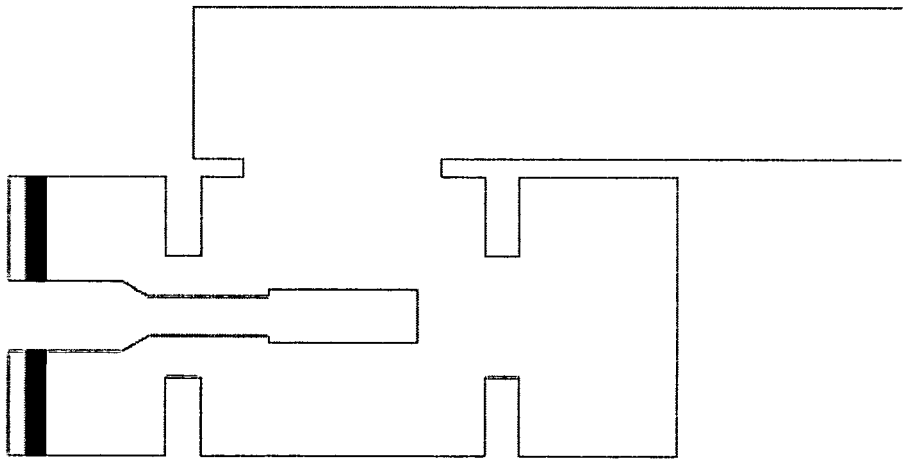
FIG. 3*b* illustrates a magnetron with an axially-orientated waveguide extractor, viewed parallel to the axis.
Figure 5A:
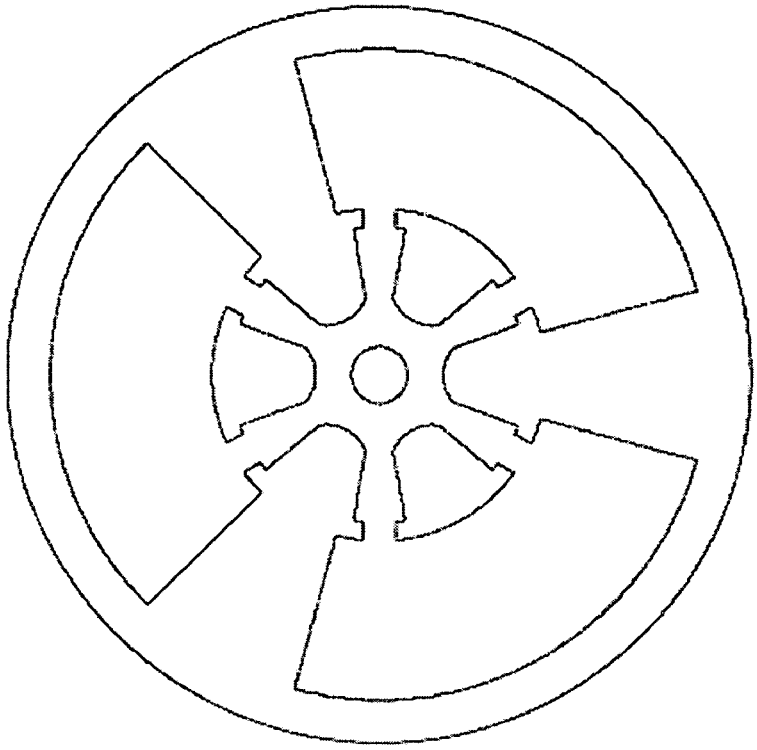
FIG. 5*a* illustrates a magnetron with the all cavity axial extractors, viewed perpendicular to the axis, with reference circle of same size as FIGS. 1 and 3*a*.
Figure 5B:
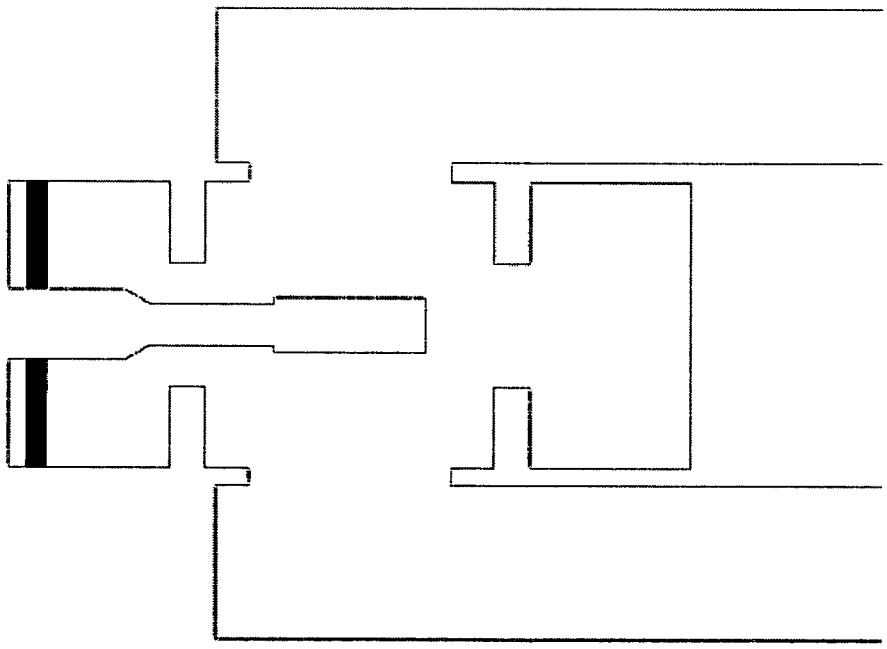
FIG. 5*b* illustrates a magnetron with the all cavity axial extractors, viewed parallel to the axis.

The six-cavity axial extractor of this example was formed by connecting three of the 90° sectoral modified waveguides to two adjacent magnetron cavities, as shown in FIGS. 5*a* and 5*b*. A comparison of FIGS. 1, 3*a* and 5*a* clearly shows that the axial extractor is the most compact extraction scheme. An analysis of all three configurations using a simulation with the Improved Concurrent Electromagnetic Particle In Cell (ICEPIC) code demonstrated the axial extractor resulted in approximately 5% more power extracted from the magnetron, as well as producing far cleaner power signals.

In addition to the advantages of being compact and effectively extracting power, an additional advantage of the axial extractor is that it improves the performance of the magnetron. This performance improvement is accomplished in several ways. First, the axial extractor eliminates the parasitic 0 mode from the device. Second, the axial extraction equally loads each magnetron cavity, thus lowering the cavity voltage, and thus lowering the field stress inside the device, compared to non-axial extraction schemes. Finally, the axial extraction also lowers the frequency of oscillation in the device. While at first this lowered frequency of oscillation may appear to be a disadvantage, the effect is quite easily overcome by making the magnetron itself slightly smaller. By making the magnetron smaller, the compactness of the overall device is once again enhanced without a loss of extracted power. Alternatively, the smaller magnetron could allow for more room for electromagnetic radiating structures, without sacrificing the compactness desired.

Another advantage is that power is extracted using the axial extractor into the lowest order waveguide mode, which is very easy to radiate.

Finally, it should be noted that while this built and tested example focuses on a six-cavity magnetron, the principle could be equally applied to any magnetron with an even number of output cavities.

What is claimed is:

1. An all cavity magnetron axial extractor comprising:

a magnetron, said magnetron characterized by an even number of cavities and at least one sectoral cross section waveguide used as an axial microwave power extractor;

said at least one sectoral cross section waveguide extractor is mounted onto adjacent cavities of said magnetron, so that each cavity is connected via a coupling slot to a sectoral cross section waveguide extractor, and each sectoral cross section waveguide extractor is connected to two adjacent cavities without overlap;

each said at least one sectoral cross section waveguide extractor is orientated with its axis parallel to the axis of the said magnetron to provide the most compact possible profile for the overall device.

2. The all cavity magnetron axial extractor in claim 1, wherein said magnetron comprises six cavities and there are three sectoral axial extractors.

3. The all cavity magnetron axial extractor in claim 1, wherein said at least one sectoral axial extractor is a 90° sector which has an inner radius of approximately 8.59 cm, an outer radius of approximately 16.85 cm, and a height of approximately 8.25 cm.

4. The all cavity magnetron axial extractor in claim 2, wherein said at least one sectoral axial extractor is a 90° sector which has an inner radius of approximately 8.59 cm, an outer radius of approximately 16.85 cm, and a height of approximately 8.25 cm.

* * * * *